United States Patent [19]

Muzslay

[11] Patent Number: 4,828,510

[45] Date of Patent: May 9, 1989

[54] CONNECTOR LATCHING ARRANGEMENT

[75] Inventor: Steven Z. Muzslay, Huntington Beach, Calif.

[73] Assignee: ITT Corporation, New York, N.Y.

[21] Appl. No.: 188,563

[22] Filed: Apr. 29, 1988

[51] Int. Cl.[4] ..... H01R 13/627

[52] U.S. Cl. ..... 439/352; 439/159

[58] Field of Search ..... 439/345, 347, 350–358, 439/152, 159

[56] References Cited

U.S. PATENT DOCUMENTS

| | | | |
|---|---|---|---|
| 2,895,119 | 7/1959 | Montgomery, Jr. | 439/354 |
| 3,179,738 | 4/1965 | DeLyon | 439/350 |
| 3,711,816 | 1/1973 | Schumacher | 439/352 |
| 4,255,007 | 3/1981 | Michaels et al. | 439/353 |
| 4,273,403 | 6/1981 | Cairns | 439/357 |
| 4,527,851 | 7/1985 | Gallusser et al. | 439/271 |
| 4,623,210 | 11/1986 | Tsukakoshi | 439/358 |

FOREIGN PATENT DOCUMENTS

| | | | |
|---|---|---|---|
| 1500722 | 4/1975 | United Kingdom . | |
| 2071928 | 9/1981 | United Kingdom | 439/358 |
| 2195501 | 4/1988 | United Kingdom . | |

*Primary Examiner*—Gary F. Paumen

*Attorney, Agent, or Firm*—Thomas L. Peterson

[57] ABSTRACT

A latching arrangement for a connector is disclosed in which the cooperating latch elements are located inside the connector bodies whereby they are relatively well protected from damage. Latch levers mounted by torsion pivots on the plug ride up ramps on a center latch dog on the receptacle until latching shoulders on the levers engage catch shoulders on the dog to lock the plug and receptacle together. An interfacial seal between the plug and receptacle connector bodies urge the latching shoulders on the levers into firm engagement with the catch shoulders on the latch dog. This arrangement provides self ejection of the plug from the receptacle if the two parts are not fully mated.

4 Claims, 5 Drawing Sheets

FIG. 2
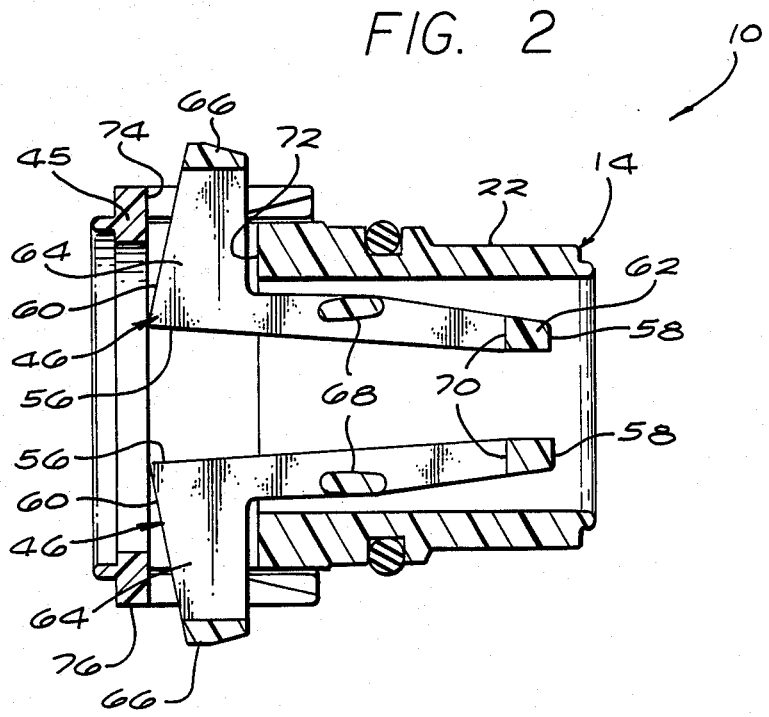
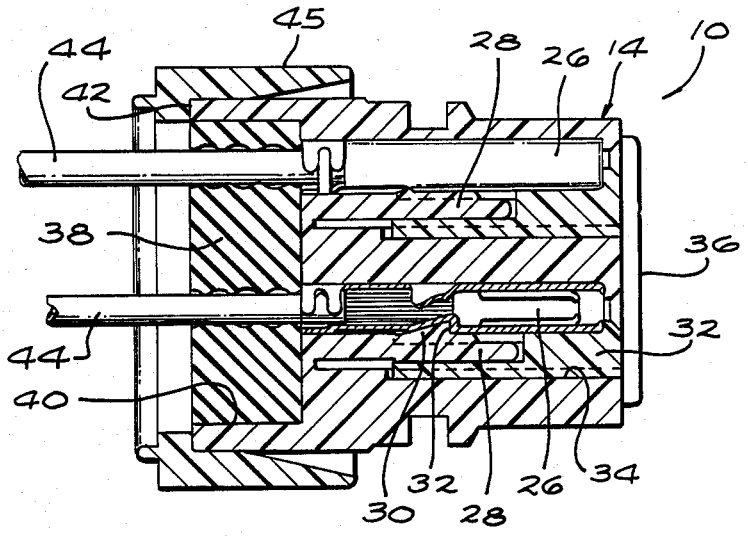
FIG. 3

FIG. 4a
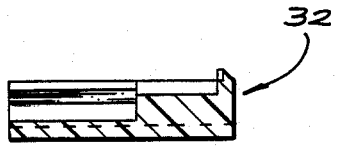
FIG. 4b
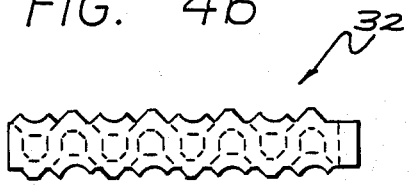
FIG. 5
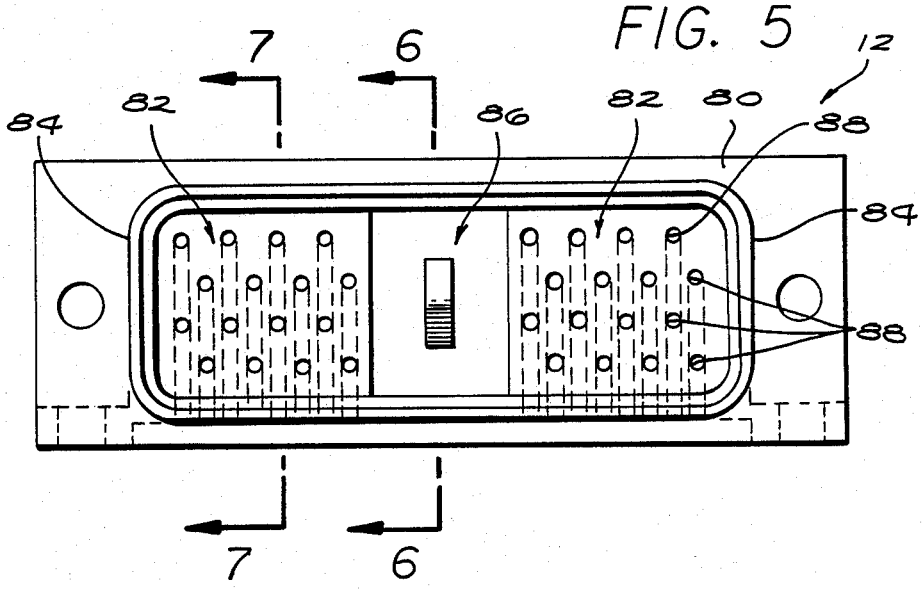
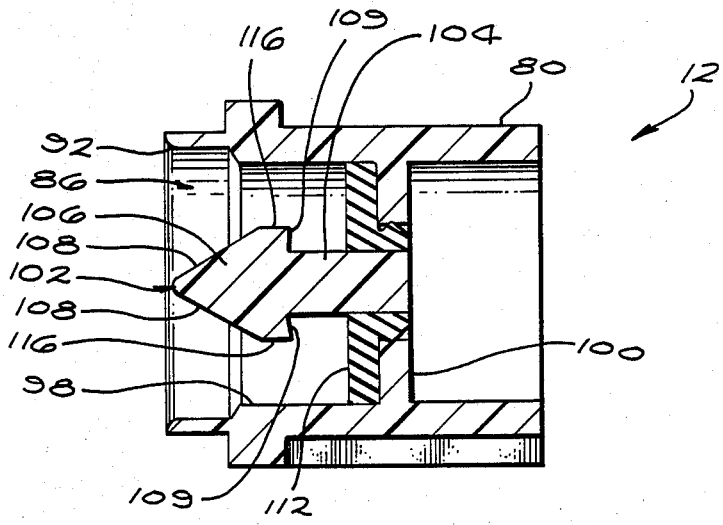
FIG. 6

CONNECTOR LATCHING ARRANGEMENT

BACKGROUND OF THE INVENTION

The present invention relates generally to a connector assembly and, more particularly, to an improved latching arrangement for a connector.

While the present invention will be described herein as being applied to an electrical connector, it will be appreciated that the invention could also be used in connection with a fiber optic connector.

It is common practice in the electrical connector art to provide on an all plastic connectors an integral latching arrangement which will allow positive locking together of the mating connector halves thereby insuring that electrical continuity is maintained under varying conditions of vibration and separating forces which would otherwise result in the loss of electrical continuity. Typically, the latching arrangement includes an integral, molded-in lever which is pivotable about a leg that extends outwardly a substantial distance from the housing of one of the connector halves, and embodies a latch shoulder which is engaged with a catch on the mating connector half when the two halves are interengaged. While such latching arrangements are generally satisfactory, they have the disadvantage that because they extend outwardly a substantial distance from the housing of the connector, the latch levers are exposed so they could inadvertently be damaged during handling of the connector, and the connector has a relatively high profile which may be objectionable if space is at a premium in the environment in which the connector is intended to be utilized.

U.S. Pat. Nos. 4,431,244 and 4,639,061, assigned to the assignee of the present application, disclose latching arrangements for electrical connectors in which the latch levers are mounted to the connector body by torsion pivots which allows the profiles of the connector to be somewhat smaller than that of the other connectors discussed previously herein. However, the latch levers are still exposed so that they could possibly be damaged or inadvertently released, if engaged by a rigid or sharp object.

It is the object of the present invention to provide an improved latching arrangement for a connector which provides a positive interlock between the plug and receptacle halves of the connector, and is located almost entirely within the interior of the plug and receptacle so that there is less chance of damage or inadvertent release of the latching arrangement.

SUMMARY OF THE INVENTION

According to a principal aspect of the present invention, there is provided a connector comprising first and second connector members. Each connector member has an insulative body containing at least one contact section and a latching section. The latch arrangement for the connector members is mounted inside the latching sections of the connector bodies, rather than outside as in the prior art connector locking arrangement. As a consequence, the connector has a very low profile, and the latch elements are relatively well protected so that there is less chance of damage or inadvertent release of the elements.

Other aspects and advantages of the invention will become apparent from the following description taken in connection with accompanying drawings.

BRIEF DESCRIPTION OF THE DRAWINGS

FIG. 2 is a sectional view taken along line 2—2 of FIG. 1 showing the latch levers of the latching assembly of the invention;

FIG. 3 is a sectional view taken along line 3—3 of FIG. 1;

FIG. 4*a* is a longitudinal sectional view through a secondary contact lock shown in FIG. 3;

FIG. 4*b* is a front end view of the secondary contact lock illustrated in FIG. 4*a;*

FIG. 5 is a front end view of the receptacle connector member of the present invention;

FIG. 6 is a sectional view taken along line 6—6 of FIG. 5 showing the latch dog which cooperates with the latch levers in the plug;

DESCRIPTION OF THE PREFERRED EMBODIMENTS

Figure 1:
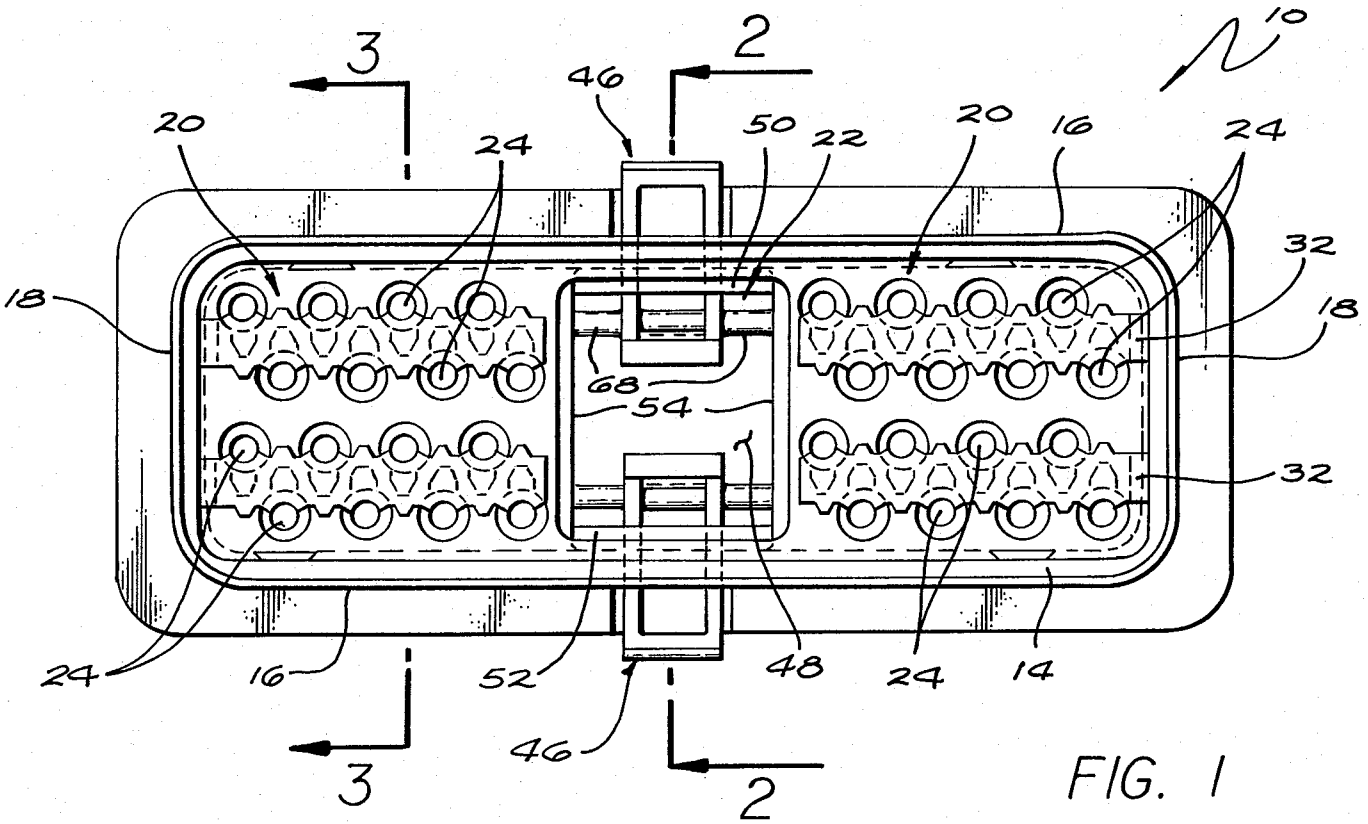
FIG. 1 is a front end view of the plug connector member of the present invention.
Figure 7:
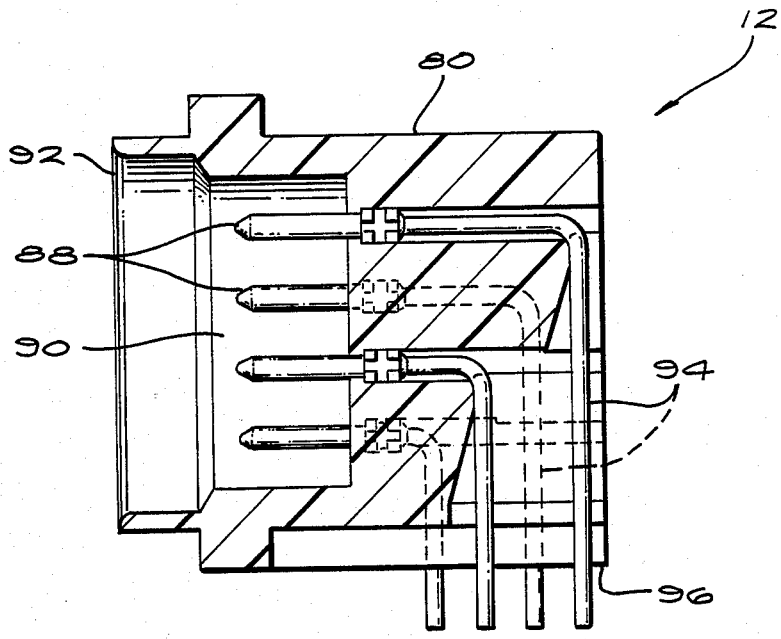
FIG. 7 is a sectional view taken along line 7—7 of FIG. 5.

Referring now to the drawings in detail, the plug connector member of the present invention, generally designated 10, is illustrated in FIGS. 1–4. The plug is engageable with a mating receptacle connector member 12, which is shown in FIGS. 5–7. The plug 10 comprises a rectangular insulative connector body 14 having relatively long sides 16 and relatively short sides 18. The plug has two contact sections 20 adjacent to the short sides 18 of the connector body, and an intermediate latching section 22.

Each contact section 20 contains four rows of contact cavities 24. Contacts 26 are retained in the cavities by means of resilient contact retention fingers 28. Each finger has a locking tab 30 which engages within a groove 32 in the contact to restrict axial movement of the contact in the cavity. The retention fingers 28 are held in their locked position by means of secondary contact locking strips 32 which are mounted in slots 34 that open at the front end 36 of the plug body 14. An elastomeric grommet 38 is mounted in a recess 40 formed in the rear end 42 of the body 14. The grommet provides a seal to the insulated wires 44 connected to the contacts 26. The contacts 26 are adapted to engage with mating pin contacts, to be described later herein, mounted in the receptacle when the plug and receptacle are interengaged. A rectangular shaped end bell 45 is mounted over the rear of the body 14 to hold the grommets 38 in the contact sections of the plug body. The end bell is secured to the plug body by suitable latch tabs, not shown.

The latching arrangement for the plug and receptacle include two latch elements 45 that are mounted in the latching section 22 of the plug body 14. The latching section 22 is defined by a rectangular opening 48 having a top 50, a bottom 52 and two sides 54. The latch elements 46 are identical. One latch element is mounted adjacent to the top 50 of the opening 48, while the other is mounted adjacent to the bottom 52, and they are reversed relative to each other. Each latch element comprises a pair of latch levers 56 each having a front end 58 and a rear end 60. A cross bar 62 connects the front ends 58 of the levers. Outwardly extending arms 64 are formed on the rear ends 60 of the levers, and are joined at their outer ends by a second cross bar 66. The latch elements are connected to the sides 54 of the rectangular opening 48 by live hinge pivots 68, which are integral with the levers intermediate their ends 58 and 60. The rear of each cross bar 62 forms a latching shoulder 70. The arms 64 of the levers extend outwardly through slots 72 in the rear of the connector body 14, and through aligned slots 74 in the end bell 45.

As seen in FIG. 2, the cross bars 66 extend outwardly beyond the outer surface 76 of the end bell 45 a sufficient distance so that when the cross bars are pushed inwardly toward each other, the levers 56 will pivot from the position shown in full lines in FIG. 2 to the position shown in dashed lines. This causes the live hinge pivots 68 to undergo torsion, urging the forward ends of the levers toward each other to a locking position, as will be seen later herein.

The receptacle 12 comprises a rectangular insulative connector body 80 having contact sections 82 adjacent to its sides 84 and an intermediate latching section 86, each shaped and located to mate with the corresponding contact and latching sections of the plug 10 when the plug and receptacle are interengaged. Each contact section 82 of the receptacle contains four rows of pin contacts 88 extending into a recess 90 that opens at the front 92 of the receptacle body 80. The pin contacts 88 are arranged to mate with the corresponding socket contacts 26 in the plug 10. Each pin contact has a right angle terminal 94 which extends downwardly through the bottom 96 of the receptacle body 80.

The latching section 86 comprises a rectangular recess 98 which is dimensioned and shaped to slideably receive the corresponding latching section 22 of the plug 10. The recess 98 opens at the front-face 92 of the receptacle body 80. A support wall 100 extends tranversely across the latching section 86 of the receptacle 12. A latch dog 102 is formed in the center of the wall 100. The latch dog comprises a stem 104 which is integral with the wall 100, and an enlarged head 106. Angular, outwardly diverging ramps 108 are formed on the head 106. The ramps leads to rearwardly facing catch shoulders 109, that preferably are inclined at a reverse angle. In the molding of the receptacle body 80, core pins, not shown, must be used to form the shoulders 108, which results in slots 110 being formed in the wall 100 both above and below the stem 104. An interfacial elastomeric seal 112 is mounted on the front face of the wall 100. The seal embodies two rearwardly extending projections 114 that have an interference fit in the slots 110 to hold the seal in place.

Figure 8:
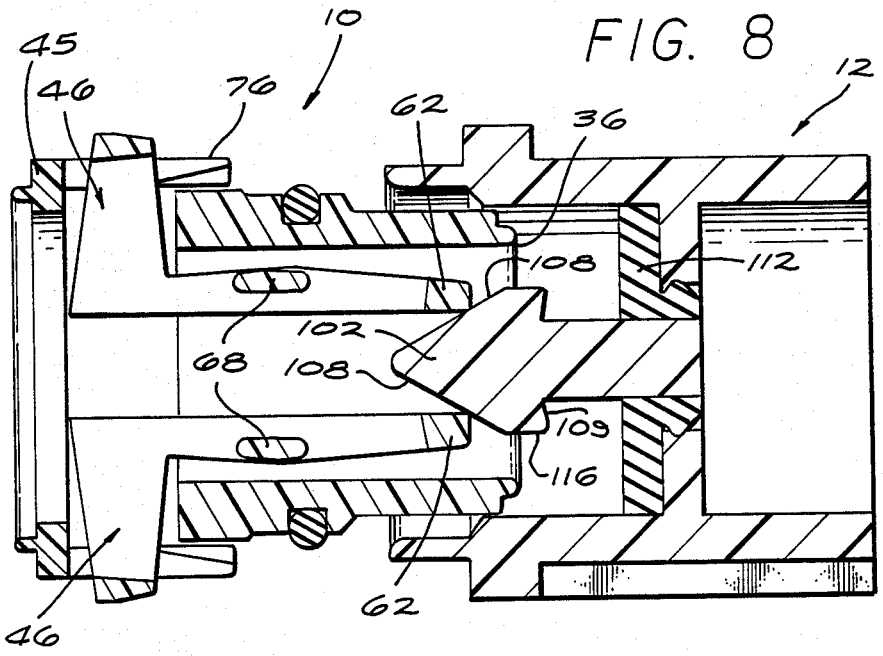
FIG. 8 is a longitudinal sectional view through the latching sections of the plug and receptacle, showing the two parts partially mated.
Figure 9:
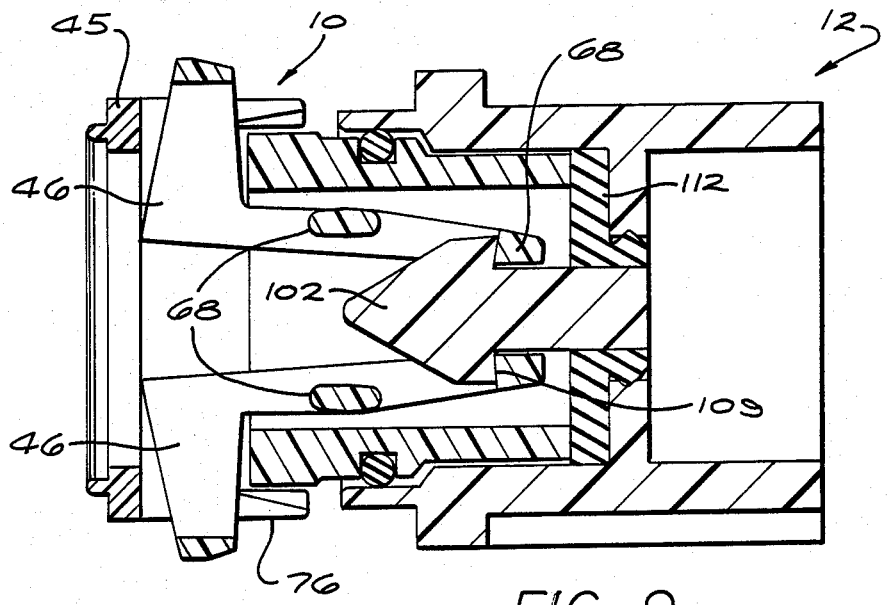
FIG. 9 is a sectional view similar to FIG. 8, but showing the condition of the latching arrangement when the plug and receptacle are fully mated.
Figure 10:
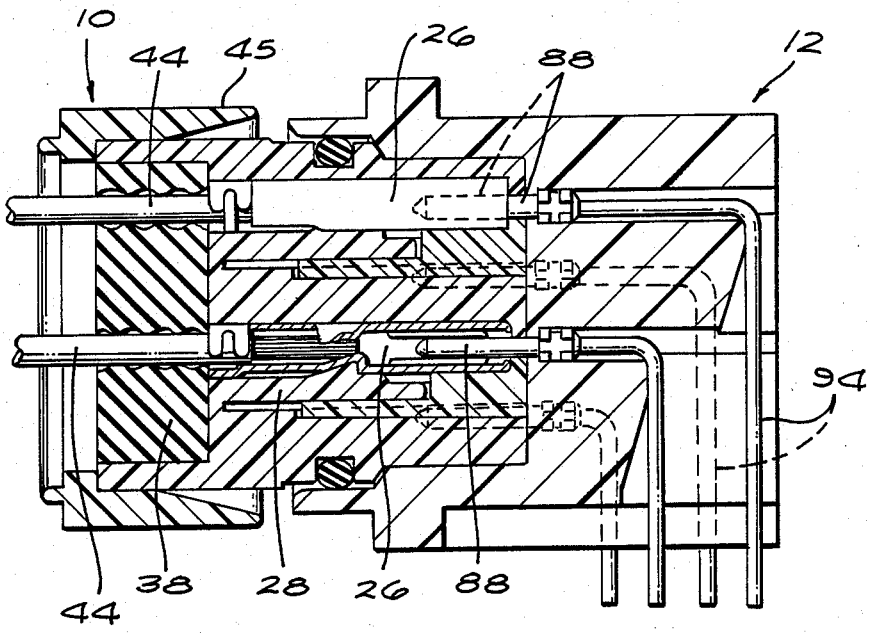
FIG. 10 is a longitudinal sectional view through the contact sections of the plug and receptacle when fully mated.

In order to mate the plug and receptacle, the two parts are positioned as illustrated in FIG. 8 and pushed together, causing the cross bar 62 on the front of the latch elements 46 to commence riding up the ramps 108 on the latch dog 102, which causes the live hinge pivots 68 to undergo torsion, tending to urge the front ends of the latch elements 46 inwardly toward each other. Further pushing of the plug into the receptacle causes the latch elements 46 to ride up onto the rear, generally parallel upper and lower surfaces 116 of the latch dog, generally to the position shown in dashed lines in FIG. 2, until the cross bars 62 pass the catch shoulders 109 on the latch dog, whereupon the cross bars 62 will snap inwardly due to the release of the torsion forces on the live hinge pivots 68, thereby positioning the latching shoulders 70 on the cross bars behind the catch shoulders on the latch dog to lock the plug and receptacle together, as seen in FIG. 9. When the plug and receptacle are fully mated, the forward end 36 of the plug body compresses the elastomeric seal 112, sealing the interface between the plug and receptable in the latching section of the connector members, and further causing a force to be applied between the cross bars on the latch elements 46 and the catch shoulders 109 on the latch dog, so that a firm positive interlock is provided between the plug and receptacle.

The cross bars 66 of the latch elements 46 extend a sufficient distance beyond the outer surfaces 76 of the end bell 46 so that when the cross bars are pushed inwardly toward each other with their outer surfaces flush with the outer surfaces 76 of the end bell, the cross bar 62 will be separated a sufficient distance to release the latching shoulders 70 from the catch shoulders 109 on the latch dog 102 to release the latching arrangement and allow separation of the plug and receptacle. The end bell 45 assures that the latch elements 46 can be pivoted only a predetermined distance since the operator's fingers engaging the cross bars 66 will bottom out against the outer surfaces 76 of the end bell, thereby limiting the amount of torsion under which the live hinge pivots 68 can undergo. This avoids overstressing of the pivots which could damage them.

It will be appreciated that when the front ends of the latch elements 46 ride up over the ramps 108 on the latch dog 102, because the live hinge pivots undergo torsion, a force will be created having an axial component tending to separate the plug and receptacle. Further, compression of the interfacial seal 112 upon engagement by the front end of the plug body 14 creates a force tending to push the plug body rearwardly relative to the receptacle. This combination of separation forces is substantially greater than the force required to engage the contact sections of the plug and receptacle so that if the plug and receptacle are not fully mated, the aforementioned separation forces will be sufficient to automatically eject the plug from the receptacle. Stated in other words, the insertion force required to push the cross bars on the forward ends of the latch elements over the ramps on the latch dog and the force required to compress the interfacial seal are substantially greater than the insertion force of the contact sections of the plug and receptacle so that the plug will be automatically ejected from the receptacle if they are not fully mated. This assures that the plug and receptacle will not be simply partially mated, with the pin and socket contacts not being fully interengaged.

From the forgoing, it will be appreciated that by the present invention the latching arrangement is protected from damage or inadvertent release since the latching parts are located within the interior of the plug and receptacle. Further, by the use of the latching arrangement of the present invention, a connector is provided having a relatively low profile so that the connector may be used in environments where space is at a premium. Further, because the latching arrangement is located in the center of the connector, the latching forces on the plug and receptacle are distributed uniformally across their width so that cocking of the plug and receptacle will not occur.

While the present invention has been described in connection with a retangular connector, the latching arrangement could also be utilized with circular connectors. Further, although it is preferable to utilize a pair of latch elements 46 as described herein, it would also be possible to use only one latch element with a cooperating catch shoulder on the receptacle, but in that case the cooperating latching shoulder should be located on the center axis of the plug and receptacle. Further, the latch elements 46 could employ only a single latch lever, rather than two levers joined by cross bars, provided that a suitable latching shoulder is provided adjacent to the front end of the lever.

Although several embodiments of the invention have been disclosed herein for purposes of illustration, it will be understood that various changes can be made in the form, details, arrangement and proportions of the various parts in such embodiments without departing from the spirit and scope of the invention as defined by the appended claims.

What is claimed is:

1. A connector comprising:

mating first and second connector members each having a contact section;

each said connector member having an insulative body containing at least one contact section and a latching section;

latch means inside said latching section for releasably securing said connector members together;

said latch means comprising a pivoted, longitudinally extending lever inside said latching section of said first connector member body, said lever having a latching shoulder thereon, and a latch dog inside said latching section of said second connector member body having a catch shoulder cooperating with said latching shoulder to secure said connector members together;

said lever embodying actuating means extending laterally outwardly beyond the outer periphery of said first connector member body, depressing of said actuating means releasing said latching shoulder from said catch shoulder;

said latch dog embodying an angular, outwardly diverging ramp leading to said catch shoulder;

said lever having a forward end embodying said latching shoulder, said forward end riding up over said ramp during mating of said connector members;

live hinge pivot means associated with said lever, said pivot means undergoing torsion as said forward end of said lever slides up over said ramp whereby said forward end will spring inwardly when said latching shoulder passes beyond said ramp to automatically position said latching shoulder behind said catch shoulder;

a support wall in said latching section of said second connector member spaced behind said catch shoulder on said latch dog;

resilient means on the front of said wall; and said first connector member body compressing said resilient means when said connector members are fully mated thereby urging said latching shoulder into locking engagement with said catch shoulder.

2. A connector comprising:

mating first and second connector members;

a pivoted, longitudinally extending lever on said first connector member having a forward end embodying a latching shoulder;

a catch shoulder on said second connector member cooperating with said latching shoulder to secure said connector members together;

an angular, outwardly inclined ramp on said second connector member leading to said catch shoulder;

said forward end of said lever riding up over said ramp during mating of said connector members until said latch shoulder becomes positioned behind said catch shoulder;

a support wall on said second connector member spaced behind said catch shoulder;

resilient means on the front of said wall; and said first connector member compressing said resilient means when said connector members are fully mated thereby urging said latching shoulder into locking engagement with said catch shoulder.

3. A connector comprising:

mating first and second connector members each having a contact section;

a longitudinally extending lever on said first connector member having a forward end embodying a latching shoulder;

live hinge pivot means pivotally connecting said lever to said first connector member;

a catch shoulder on said second connector member cooperating with said latching shoulder to secure said connector members together;

an angular, outwardly inclined ramp on said second connector member leading to said catch shoulder;

said forward end of said lever riding up over said ramp during mating of said connector members until said latching shoulder becomes positioned behind said catch shoulder;

said pivot means undergoing torsion as said forward end of said lever rides up over said ramp;

said contact sections of said connector members engaging at a predetermined force;

resilient means in said second connector member being compressed by said first connector member when said first and second connector members are mated; and the insertion force required to push said forward end of said lever over said ramp and to compress said resilient member is substantially greater than said predetermined force, whereby said first connector member will be automatically ejected from said second connector member by said resilient member and by said torsion of said pivot means if said connector members are not fully mated.

4. A connector as set forth in claim 3 wherein:

said resilient means urges said latching shoulder into locking engagement with said catch shoulder.

* * * * *